US008567335B2

(12) United States Patent
Johnson, III et al.

(10) Patent No.: US 8,567,335 B2
(45) Date of Patent: Oct. 29, 2013

(54) DEPLOYMENT AND RETRIEVAL OF FLOATABLE OBJECTS

(75) Inventors: Waverly Johnson, III, Houston, TX (US); Hong Tri Thoi, Lancaster (GB)

(73) Assignee: First Subsea Limited, Lancaster (GB)

( * ) Notice: Subject to any disclaimer, the term of this patent is extended or adjusted under 35 U.S.C. 154(b) by 420 days.

(21) Appl. No.: 12/919,850

(22) PCT Filed: Feb. 27, 2009

(86) PCT No.: PCT/GB2009/050206
§ 371 (c)(1),
(2), (4) Date: Aug. 27, 2010

(87) PCT Pub. No.: WO2009/106900
PCT Pub. Date: Sep. 3, 2009

(65) Prior Publication Data

US 2011/0011325 A1 Jan. 20, 2011

(30) Foreign Application Priority Data

Feb. 29, 2008 (GB) ..... 0803790.5

(51) Int. Cl.
*B63B 27/00* (2006.01)

(52) U.S. Cl.
USPC ..... 114/268

(58) Field of Classification Search
USPC ..... 114/213, 219, 230.1, 230.2, 268, 269, 114/382, 365, 377, 378, 379, 380, 114/230.22–230.26, 230.27, 230.29, 114/215–217
See application file for complete search history.

(56) References Cited

U.S. PATENT DOCUMENTS

| | | | | | |
|---|---|---|---|---|---|
| 1,043,625 | A | * | 11/1912 | Petrie | 294/82.27 |
| 1,828,363 | A | * | 10/1931 | Fuller | 114/373 |
| 4,351,260 | A | | 9/1982 | Tuson et al. | |
| 4,586,453 | A | * | 5/1986 | Wilks et al. | 114/368 |

FOREIGN PATENT DOCUMENTS

| | | | |
|---|---|---|---|
| DE | 29911472 | U1 | 11/1999 |
| DE | 102006032299 | B3 | 12/2007 |
| FR | 919091 | A | 2/1947 |
| GB | 2217671 | A | 11/1989 |
| GB | WO 2004/094225 | A1 | 11/2004 |
| WO | WO2004055394 | A1 | 7/2004 |

OTHER PUBLICATIONS

First Subsea Limited et al., International Search Report dated Nov. 5, 2010 issued in parent International Patent Application No. PCT/GB2009/050206 (Publication WO 2009/106900 A3, Sep. 3, 2009), 4 pages.

* cited by examiner

*Primary Examiner* — Daniel Venne
(74) *Attorney, Agent, or Firm* — Jeffrey G. Sheldon; Sheldon Mark & Anderson

(57) ABSTRACT

A ship s fender system and method of deployment and retrieval comprising a group of fenders (12) linked together to lie on the surface of the water adjacent a ship s hull (11) with hauling lines (14) connected by davits (15) to winches to lower and raise the fenders. Each hauling line (14) is connected to its respective fender by a two-part ball and tape connector so that connection and release of the hauling lines (14) is carried out automatically and remotely thus avoiding the need for the conventional hazardous procedure whereby the lines are connected and disconnected manually by a crew in a boat. The system may be used to deploy and retrieve other floatable objects such as working platforms or submersible vehicles.

17 Claims, 2 Drawing Sheets

DEPLOYMENT AND RETRIEVAL OF FLOATABLE OBJECTS

CROSS-REFERENCE TO RELATED APPLICATIONS

The present Application is a national stage of International Patent Application No. PCT/GB2009/050206, titled "Deployment and Retrieval of Floatable Objects," filed Feb. 27, 2009, which claims priority from British Patent Application No. GB 0803790.5 filed Feb. 29, 2008, the contents of which are incorporated in this disclosure by reference in their entirety.

This invention concerns the automated deployment and retrieval of floatable objects such as one or more fenders to be placed against the hull of a large vessel when moored against another vessel or other structure. Other floatable objects to be deployed and retrieved may include, for example, a lifeboat or working platform, or a submersible vehicle.

In the case of fenders, typically, four or more large air-filled fenders need to be lowered onto the surface of the water and then retrieved when required to be stowed on deck or on the quayside. Fenders are usually suspended from davits on hauling lines connected to winches for lowering and raising the fenders when required. Such fenders typically are some two metres long, weighing in the order of five tonnes and deployed as floatation devices.

The fenders are deployed usually linked together by a flexible chain or cable and at least one of a series of such fenders will be tethered to the vessel or to the quayside to prevent them from drifting away from the side of the vessel.

The deployment and retrieval operation is traditionally carried out by a crew in a small boat manually connecting and disconnecting the hauling lines with respect to the fenders. This is a hazardous operation, particularly in adverse sea conditions and can easily cause injury or even loss of life.

It is an object of the present invention to provide a system of deployment and retrieval of such objects which can be operated remotely and automatically thus avoiding the need for personnel to be present on the water.

The invention involves the use of so-called ball and taper devices forming a two-part male/female connector, the male part of which forms a tool including a mandrel having a tapered wall part surrounded by a cage with balls or rollers cooperating with the tapered wall part thus to move outwardly upon relative movement of the body and the cage such that the balls or rollers extend through apertures in the cage to grip a surrounding wall of a female part into which the tool is placed. Such devices are known, for example, for the retrieval of pipes by locating the tool inside an end region of a pipe so that the balls or rollers engage the internal surface of the pipe to grip it.

According to a first aspect of the present invention there is provided a system for 5 deployment and retrieval of a floatable object, the system including retrieval apparatus for hauling the object into an elevated stowed position, the retrieval apparatus comprising at least one hauling line, a winch for reeling in and letting out the hauling line, and a connector for attaching and releasing the hauling line with respect to the object; characterised in that the connector comprises a two-part device, one part of which is 10 provided on the hauling line, the other part being provided on the object; and in that the two parts are adapted automatically to become locked together when inter-engaged and when tension is applied to the hauling line.

The object may be a fender for a water-borne vessel.

The hauling line and two-part connector may be provided at two opposed ends of the object.

The or each two-part connector may comprise a ball and taper device with remotely operable releasing means to enable disengagement and separation of the two parts of the connector.

One part of the or each two-part connector may include a fairing to facilitate automatic docking and inter-engagement of the parts.

The system may include a plurality of objects connected together by flexible lines.

At least one of the objects may be tethered to prevent it from drifting away from the vessel when released from its associated hauling line.

The connector part associated with the object may be formed as a receptacle rotatably mounted on the object and counterbalanced to remain upright in a position to receive and engage the connector part on the hauling line.

According to a further aspect of the present invention there is provided a method of deployment and retrieval of one or more floatable objects, comprising the steps of suspending the or each object on at least one hauling line attached to a winch, with a two-part connector between the object and the hauling line, the two parts of the connector being automatically locked together releasably when inter-engaged and with the line in tension, operating the winch to pay out the hauling line and to lower the object until it becomes water-borne, remotely releasing the two-part connector to detach the hauling line from the object, and subsequently retrieving the object by remotely re-engaging the two parts of the connector and operating the winch to draw up the hauling line thus applying tension thereto so that the two parts of the connector become locked together to enable the object to be lifted and retrieved.

The or each hauling line may be retracted by the winch after release of the associated object.

A plurality of objects linked together by flexible lines may be simultaneously deployed and simultaneously retrieved, at least one of said objects being tethered to prevent it from drifting away.

The or each connector may be a ball and taper device including a tool which is lowered into a receptacle to engage the connector and automatically to lock it when tension is subsequently imposed upon the hauling line, inter-engagement being assisted by a fairing at the mouth of the receptacle and by means to maintain the receptacle in an upright position.

An embodiment of the invention, as applied to the deployment and retrieval of fenders alongside a vessel or quayside, will now be described, by way of example only, with reference to the accompanying drawings in which:

FIGS. 1*a* to 1*c* schematically illustrate a known ball and taper device in three operational positions;

Figures 1A, 1B, 1C:
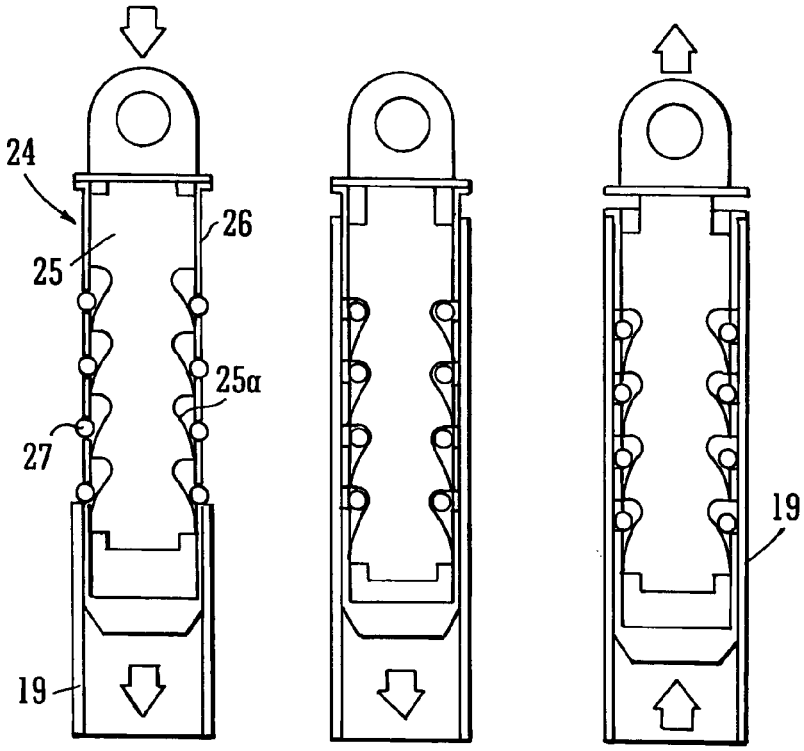

Referring initially to FIGS. 1*a* to 1*c*, a known ball and taper device comprises a tool 24 having a mandrel 25 surrounded by a cage 26 with balls or rollers 27 partly exposed through apertures in the wall of the cage 26 and residing in tapered ramps 25*a* formed on the outer surface of the mandrel 25 at spaced positions circumferentially and longitudinally thereof.

A ball and taper device of this kind operates such that relative movement of the mandrel 25 and the cage 26 causes the balls 27 to ride up or down the ramps 25*a* so that the balls either extend outwardly through their associated apertures or are retracted within them.

In FIG. 1*a* the tool 24 is shown at the commencement of its introduction into a receptacle 19.

In FIG. 1*b* the tool 24 is fully inserted into the receptacle 19 and the balls 27 are at the innermost positions of their associated ramps 25*a*.

Referring now to FIG. 1*c*, upon subsequent upwards movement of the mandrel 25 relative to the cage 26 the balls 27 are caused to ride outwardly on their ramp surfaces 25*a* and to extend through their associated apertures in the cage 26 thus to grip the inner wall surface of the receptacle 19 so that the two parts of the device, namely the tool 24 and the receptacle 19, become firmly locked together enabling the receptacle 19 to be lifted.

In ball and taper devices of this kind the two parts can be released by clamping together the mandrel 25 and the cage 26 such that the balls 27 reside at the innermost end of the ramp surfaces as can be seen in FIG. 1*b*. In this condition therefore the tool 24 can be withdrawn from the receptacle 19.

Figure 2:
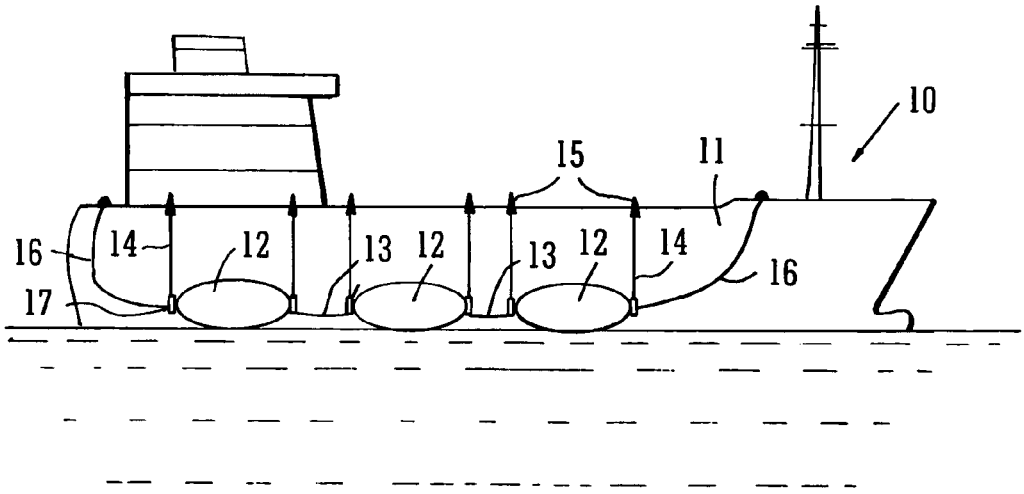
FIG. 2 illustrates a vessel having a fender system and method of deployment according to the present invention.

Referring now to FIG. 2, large vessels such as that illustrated at 10 are often required to be moored for an extended period either against another vessel or other structure while cargo is loaded or unloaded. During this time it is essential to protect the ship's hull 11 with a series of fenders 12, usually large air-filled buoys weighing in the region of five tonnes each to be water-borne against the side of the vessel and inter-connected end-to-end by chains or cables 13.

The fenders 12 are adapted to be lowered and retrieved on hauling lines 14 mounted on davits 15 and connected to associated winches on board the vessel and each of the hauling lines 14 is releasably attached to a connector 17 at one end of an associated fender. Preferably, at each end of a series of objects a tethering line 16 is provided to prevent the group of tenders from drifting away from the vessel.

Conventionally, it is necessary for a crew in a small boat to connect and disconnect the hauling lines 14 with respect to the connectors 17, and this can be a hazardous procedure, particularly in adverse sea conditions.

Figure 3:
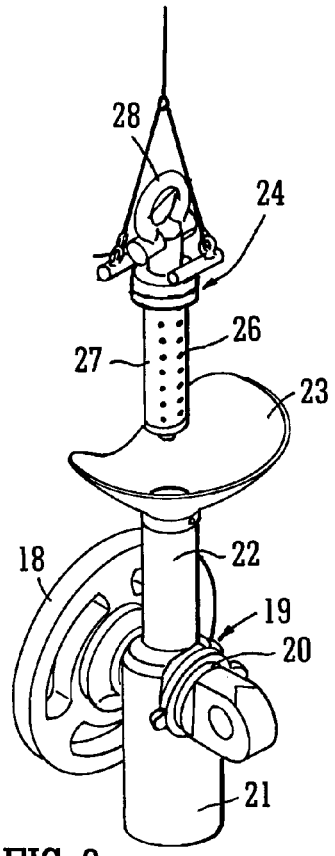
FIG. 3 is a perspective view of a two-part connector to enable a fender to be deployed and retrieved automatically, and shown in the position just prior to the two parts becoming engaged and locked together.
Figure 4:
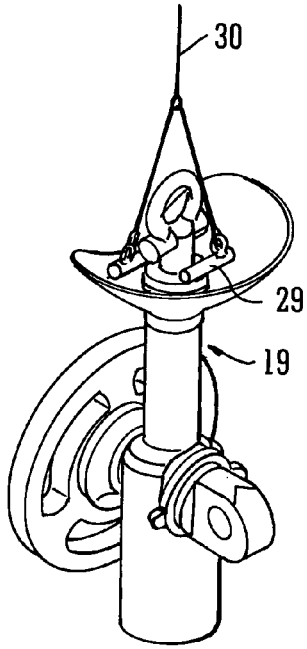
FIG. 4 is a similar view showing the connector locked.
Figure 5:
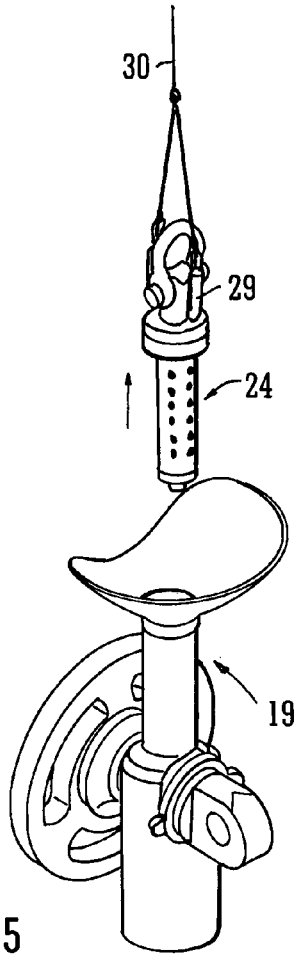
FIG. 5 shows the connector disengaged for retrieval of the hauling line.

Referring now to FIGS. 3 to 5 and in accordance with the present invention, each connector 17 is formed as a two-part ball and taper device of the kind shown in FIGS. 1*a* to 1*c* and comprising a plate 18 to be permanently attached to an end of a fender and having a horizontally extending shaft on which is rotatably mounted the receptacle 19 being one part of the two-part connector. A collar 20 ensures that the receptacle 19 is correctly located and freely rotatable on the shaft of the plate 18, and a counterweight 21 ensures that the receptacle 19 always remains in an upright position as illustrated in FIG. 3.

The receptacle 19 includes an open tubular part 22 which at its upper open end extends out into a fairing 23.

The other part of the two-part connector comprises the tool 24 of the ball and taper device having the mandrel 25 and the cage 26 with balls or rollers 27 partly exposed through apertures in the cage 26.

In this example, when the tool 24 is lowered into the tubular part 22 of the receptacle 19 the balls 27 are loosely engaged within the apertures, but when a hauling line 14 is connected by a shackle 28 to the mandrel 25 and tension is applied to the hauling line then the relative movement of the body within the cage causes the balls to ride up their respective ramps to grip the inner wall surface of the tubular receptacle so that the two parts of the connector are then firmly locked together. The greater the load on the hauling line 14 the greater is the locking inter-engagement of the two parts of the connector and so the fenders 12 can be hauled upwardly by their respective winches onto the deck of the vessel or onto an adjacent quayside. The locked and hauling condition is illustrated in FIG. 4.

As can be seen in FIGS. 3 to 5, the mandrel 25 of each tool 24 has a pair of release catches 29 both connected to a release line 30.

When the fenders are deployed on the surface and it is required to release the hauling lines 14, the release line 30 is pulled thus rotating the catches 29 which causes the ball cage 26 to be retracted as illustrated in FIG. 1*b*, whereupon the balls 27 release their grip upon the internal wall surface of the receptacle and so the tool 24 can be withdrawn therefrom and the hauling lines 14 can be retracted from the fenders.

When it is required once again to retrieve the fenders then the hauling lines 14 are again lowered so that the connectors 17 become re-engaged, as illustrated in FIGS. 1*a* to 1*c*, to allow the fenders to be winched up onto the deck.

By providing a hauling line 14 and connector 17 at each end of each fender and by simultaneously operating all of the associated winches, the series or group of fenders may be deployed and retrieved simultaneously and remotely without the need for manual intervention at sea level and so the whole operation can be carried out automatically and considerably more safely than the conventional method involving crews attaching and releasing the hauling lines manually.

In the example shown, the fender system is provided on board the vessel, but equally it could be provided as a fixture on a quayside and deployed to protect the hull of a moored vessel.

Also, the floatable object or objects to be deployed and retrieved may be, for example, one or more lifeboats or working platforms, a floating hose used in oil or gas transfer, or a submersible vehicle such as a small submarine. Even when the object or objects are occupied by personnel, it is of considerable advantage to be able to connect and release the hauling line or lines automatically, thus avoiding the need for manual intervention in what can be hazardous conditions.

The invention claimed is:

1. A system for deployment and retrieval of a floatable object, the system including a retrieval apparatus for hauling the floatable object into an elevated stowed position, the retrieval apparatus comprising at least one hauling line, a winch for reeling in and letting out the hauling line, and a connector for attaching and releasing the hauling line with respect to the floatable object; characterized in that the connector comprises a two-part device, one part of the two-part device is provided on the hauling line, the other part being provided on the floatable object; and in that the two-part device comprises a male part and a female part, the male part forming a tool including a mandrel having a tapered wall surrounded by a cage with balls or rollers cooperating with the tapered wall, wherein when the male part and female part are inter-engaged and when tension is applied to the hauling line, the mandrel moves relative to the cage and causes the balls or rollers to extend through apertures in the cage to grip a surrounding wall of the female part thereby locking the male part to the female part, wherein the connector comprises remotely operable release catches to enable disengagement and separation of the male part and female parts of the connector.

2. A system according to claim 1, wherein the floatable object is a fender for a water-borne vessel.

3. A system according to claim 1, wherein a hauling line and connector are provided at two opposed ends of the floatable object.

4. A system according to claim 1, wherein one of the male part and female part includes a fairing to facilitate automatic docking and inter-engagement of the male part and female part.

5. A system according to claim 1, including a plurality of the floatable objects connected together by flexible lines.

6. A system according to claim 5, wherein at least one of the plurality of the floatable objects is tethered to prevent the at least one floatable object from drifting away when released from the hauling line.

7. A system according to claim 2, wherein the floatable object includes the female part of the connector and the hauling line includes the male part of the connector, and the female part comprises a receptacle rotatably mounted on the fender and counterbalanced to remain upright in a position to receive and engage with the male part on the hauling line.

8. A method of deployment and retrieval of one or more floatable objects comprising the steps of suspending the or each floatable object on at least one hauling line attached to a winch, with a connector connecting the floatable object and the hauling line, the connector comprising a two-part device, one part of the two-part device is provided on the hauling line, the other part of the two-part device being provided on the floatable object, where the two-part device comprises a male part and a female part, the male part forming a tool including a mandrel having a tapered wall surrounded by a cage with balls or rollers cooperating with the tapered wall, wherein when the male part and female part are inter-engaged and when tension is applied to the hauling line, the mandrel moves relative to the cage and causes the balls or rollers to extend through apertures in the cage to grip a surrounding wall of the female part thereby locking the male part to the female part; the method further comprising the steps of inter-engaging the male and female parts and applying tension to the hauling line to lock the male part to the female part, operating the winch to payout the hauling line and to lower the floatable object until the floatable object becomes water-borne, remotely releasing the two-part connector to detach the hauling line from the floatable object, and subsequently retrieving the floatable object by remotely re-engaging the male part and female part and operating the winch to draw up the hauling line thus applying tension thereto so that the two parts of the connector become locked together to enable the floatable object to be lifted and retrieved.

9. A method according to claim 8, wherein the or each hauling line is retracted by the winch after release of the floatable object previously suspended on the or each hauling line.

10. A method according to claim 8, including a plurality of floatable objects linked together by flexible lines, simultaneously deployed and simultaneously retrieved with at least one of the floatable objects tethered to prevent the at least one of the floatable objects from drifting away.

11. A method according to claim 8, wherein the female part comprises a receptacle rotatably mounted on the floatable object and counterbalanced to remain upright in a position to receive and engage with the male part on the hauling line, where inter-engagement is assisted by a fairing at a mouth of the receptacle.

12. A method according to claim 8, wherein the or each floatable object is a fender for a water-borne vessel and suspended adjacent a hull of a vessel on said at least one hauling line.

13. A method according to claim 12, wherein a series of fenders and connectors are provided, the fenders being connected together and suspended on a plurality of hauling lines, each fender having one of the connectors at each of the fender's ends.

14. A system for deployment and retrieval of a floatable object, the system including a retrieval apparatus for hauling the floatable object into an elevated stowed position, the retrieval apparatus comprising at least one hauling line, a winch for reeling in and letting out the hauling line, and a connector for attaching and releasing the hauling line with respect to the floatable object; characterized in that the connector comprises a two-part device, one part of the two-part device is provided on the hauling line, respective other parts of two instances of the two-part device being provided at two opposed ends on the floatable object to receive an instance of the hauling line; and in that the two-part device comprises a male part and a female part, the male part forming a tool including a mandrel having a tapered wall surrounded by a cage with balls or rollers cooperating with the tapered wall, wherein when the male part and female part are inter-engaged and when tension is applied to the hauling line, the mandrel moves relative to the cage and causes the balls or rollers to extend through apertures in the cage to grip a surrounding wall of the female part thereby locking the male part to the female part, wherein the connector comprises remotely operable release catches to enable disengagement and separation of the male part and female parts of the connector.

15. A system for deployment and retrieval of a floatable object, wherein the floatable object is a fender for a water-borne vessel, the system including a retrieval apparatus for hauling the floatable object into an elevated stowed position, the retrieval apparatus comprising at least one hauling line, a winch for reeling in and letting out the hauling line, and a connector for attaching and releasing the hauling line with respect to the floatable object; characterized in that the connector comprises a two-part device, one part of the two-part device is provided on the hauling line, the other part being provided on the floatable object; in that the two-part device comprises a male part and a female part, the male part forming a tool including a mandrel having a tapered wall surrounded by a cage with balls or rollers cooperating with the tapered wall, wherein when the male part and female part are inter-engaged and when tension is applied to the hauling line, the mandrel moves relative to the cage and causes the balls or rollers to extend through apertures in the cage to grip a surrounding wall of the female part thereby locking the male part to the female part, and in that the floatable object includes the female part of the connector and the hauling line includes the male part of the connector, and the female part comprises a receptacle rotatably mounted on the fender and counterbalanced to remain upright in a position to receive and engage with the male part on the hauling line, wherein the connector comprises remotely operable release catches to enable disengagement and separation of the male part and female parts of the connector.

16. A method of deployment and retrieval of one or more floatable objects comprising the steps of suspending the or each floatable object on at least one hauling line attached to a winch, with a connector connecting the floatable object and the hauling line, the connector comprising a two-part device, one part of the two-part device is provided on the hauling line, the other part of the two-part device being provided on the floatable object, where the two-part device comprises a male part and a female part, the male part forming a tool including a mandrel having a tapered wall surrounded by a cage with balls or rollers cooperating with the tapered wall, the female part comprising a receptacle rotatably mounted on the floatable object and counterbalanced to remain upright in a position to receive and engage with the male part on the hauling line, where inter-engagement is assisted by a fairing at a mouth of the receptacle, wherein when the male part and female part are inter-engaged and when tension is applied to the hauling line, the mandrel moves relative to the cage and causes the balls or rollers to extend through apertures in the cage to grip a surrounding wall of the female part thereby locking the male part to the female part; the method further comprising the steps of inter-engaging the male and female parts and applying tension to the hauling line to lock the male part to the female part, operating the winch to payout the hauling line and to lower the floatable object until the floatable object becomes water-borne, remotely releasing the two-part connector to detach the hauling line from the floatable object, and subsequently retrieving the floatable object by remotely re-engaging the male part and female part and operating the winch to draw up the hauling line thus applying tension thereto so that the two parts of the connector become locked together to enable the floatable object to be lifted and retrieved.

17. A method of deployment and retrieval of one or more floatable objects, wherein each floatable object is a fender for a water-borne vessel and is suspendable adjacent a hull of the water-borne vessel on a hauling line, the method comprising the steps of suspending the or each floatable object on the or each hauling line attached to a winch, with a connector connecting the floatable object and the or each hauling line, the connector comprising a two-part device, one part of the two-part device is provided on the or each hauling line, the other part of the two-part device being provided on the floatable object, where the two-part device comprises a male part and a female part, the male part forming a tool including a mandrel having a tapered wall part surrounded by a cage with balls or rollers cooperating with the tapered wall, wherein when the male part and female part are inter-engaged and when tension is applied to the or each hauling line, the mandrel moves relative to the cage and causes the balls or rollers to extend through apertures in the cage to grip a surrounding wall of the female part thereby locking the male part to the female part; the method further comprising the steps of inter-engaging the male and female parts and applying tension to the or each hauling line to lock the male part to the female part, operating the winch to payout the or each hauling line and to lower the floatable object until the floatable object becomes water-borne, remotely releasing the two-part connector to detach the or each hauling line from the floatable object, and subsequently retrieving the floatable object by remotely re-engaging the male part and female part and operating the winch to draw up the or each hauling line thus applying tension thereto so that the two parts of the connector become locked together to enable the floatable object to be lifted and retrieved, and where a series of the fenders and the connectors are provided with the fenders being connected together and suspended on a plurality of the hauling lines, each fender having one of the connectors at each of the fender's ends.

* * * * *